United States Patent [19]

Vetter et al.

[11] 4,234,973

[45] Nov. 25, 1980

[54] TUB COVER

[75] Inventors: Craig W. Vetter, Manitou Springs, Colo.; William F. Dexter, Los Osos, Calif.

[73] Assignee: Vetter Design Works, Inc., San Luis Obispo, Calif.

[21] Appl. No.: 34,851

[22] Filed: Apr. 30, 1979

[51] Int. Cl.[3] ..... E04H 3/19; E06B 9/08; B65D 43/02

[52] U.S. Cl. ..... 4/500; 108/68; 160/133; 217/56

[58] Field of Search ..... 4/172, 172.12, 172.13, 4/172.14, 185 R, 173 R, 162; 211/60 R, 60 A; 249/65, 71, 73; 160/32, 36, 133, 23 R; 217/56, 59, 62; 108/68

[56] References Cited

U.S. PATENT DOCUMENTS

| | | | |
|---|---|---|---|
| 1,728,851 | 9/1929 | Blakely | 160/133 |
| 1,829,590 | 10/1931 | Giard | 108/68 |
| 1,950,927 | 3/1934 | McMillan | 160/133 X |
| 2,958,083 | 11/1960 | Slook et al. | 4/172.14 |
| 3,072,920 | 1/1963 | Yellott | 4/172.14 |
| 3,144,665 | 8/1964 | Meyer | 4/172.14 X |
| 3,161,296 | 12/1964 | Sartor | 211/60 R |
| 3,613,126 | 10/1971 | Granderath | 4/172.14 |
| 3,707,007 | 12/1972 | Trostler | 4/172.14 |
| 3,748,664 | 7/1973 | Morita | 4/172.14 |
| 3,864,761 | 2/1975 | Stalder | 4/172.14 |

OTHER PUBLICATIONS

"California Cooperage", Redwood Hot Tubs, p. 12, published prior to 04/30/79.

*Primary Examiner*—Stuart S. Levy

*Attorney, Agent, or Firm*—Wegner, Stellman, McCord, Wood & Dalton

[57] ABSTRACT

A cover for a hot tub has wooden or other rigid ribs secured to a flexible, resilient foamed plastic sheet. One rib is secured at an edge of the tub to anchor the cover. The cover can be rolled between an extended position overlying the tub and a rolled retracted position adjacent the tub. A pair of brackets secured to the tub each have a depression in the top surface in which the retracted rolled cover rests.

9 Claims, 5 Drawing Figures

FIG. 1
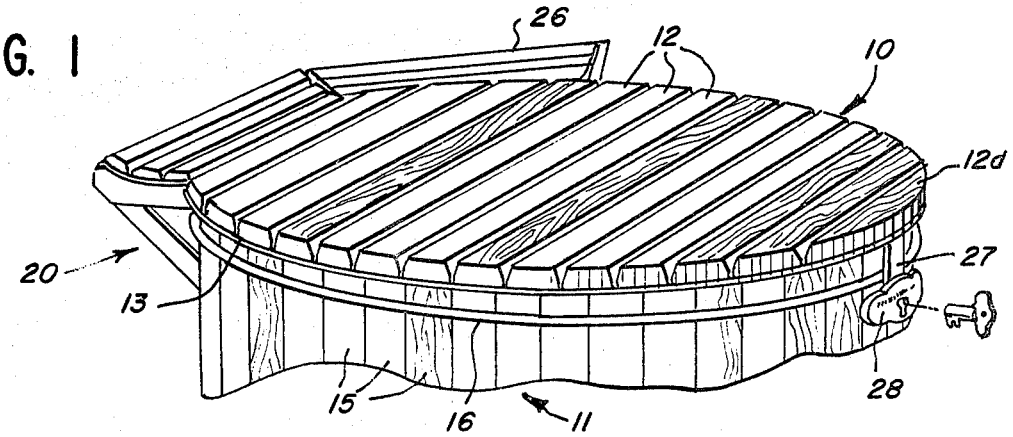
FIG. 2
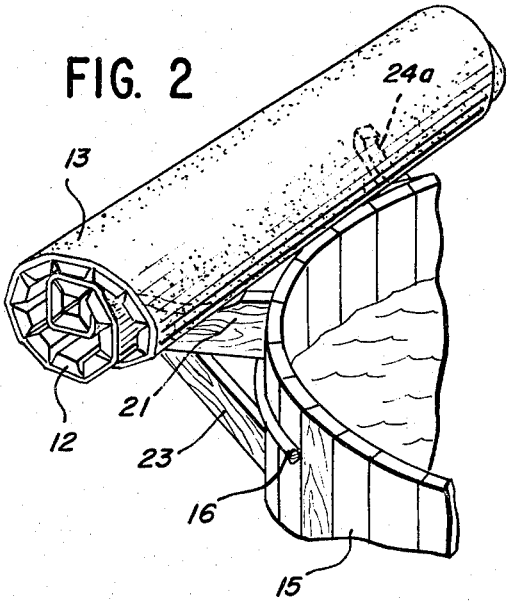
FIG. 3
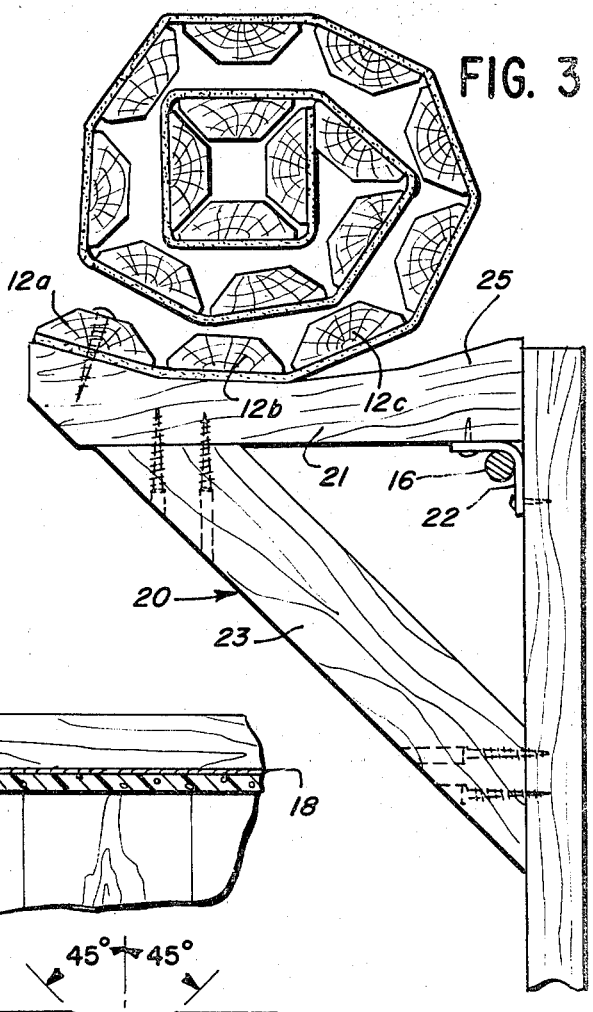
FIG. 5
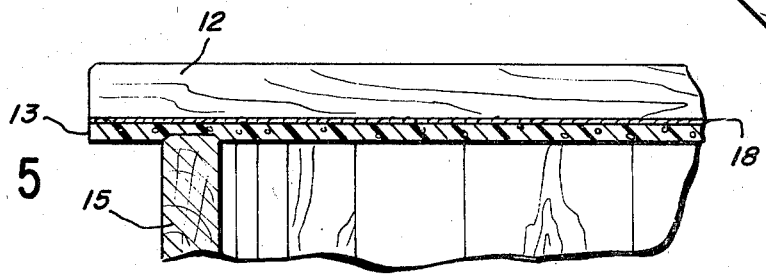
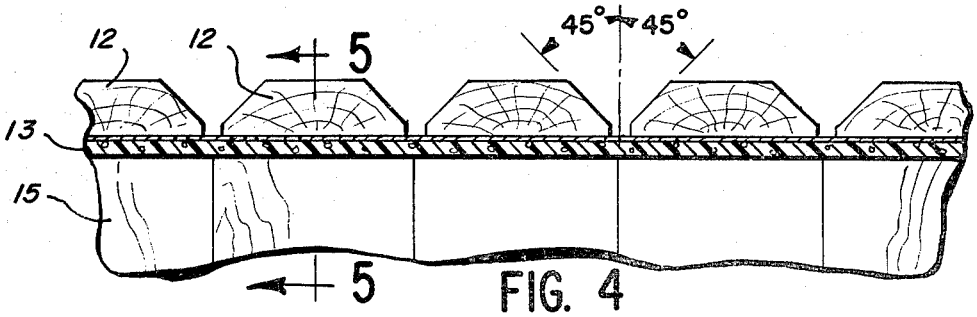
FIG. 4

TUB COVER

This invention relates to a cover for a tub and more particularly to a cover for a hot tub which may readily be removed and replaced.

A typical hot tub is cylindrical and may have a diameter of the order of four feet to eight feet. The water is generally maintained at a temperature of the order of 105° F. Heat loss when the pool is not in use is a significant problem. Covers of various types have been used to reduce heat loss and to keep foreign matter from falling into the tub. Prior covers, whether of wood, fiberglass or plastic, are bulky and heavy. They are difficult for one person to remove and replace.

In accordance with the invention, a cover is provided which may readily be rolled between extended and retracted positions.

One feature of the cover is that it includes a sheet of flexible material having a plurality of parallel ribs secured thereto. The cover is placed on the tub with the sheet of flexible material interposed between the ribs and the top of the tub wall. The ribs and sheet of flexible material may be rolled back to uncover the tub.

Another feature of the tub cover is that the flexible sheet is resilient, as of a plastic foam, and seals with the top of the tub wall further minimizing heat loss.

Still a further feature is that a rack for the rolled cover is provided adjacent the tub with a depression to hold the roll. One of the ribs is preferably secured to the bracket to anchor the cover.

Further features and advantages will readily be apparent from the following specification and from the drawings, in which:

FIG. 1 is a fragmentary perspective of a hot tub with a cover illustrating the invention extended over the top thereof;

FIG. 2 is an enlarged fragmentary perspective of the tub with the cover rolled back on a supporting rack;

FIG. 3 is an enlarged end view of the rolled cover on the rack;

FIG. 4 is a section through the extended cover at right angles to the longitudinal extent of the ribs; and FIG. 5 is a section taken along line 5—5 of FIG. 4.

In the drawings, roll cover 10 of the invention is illustrated with a wooden hot tub 11. This is a form of hot tub often used out-of-doors in areas of temperate climate. The cover may be used with other types of tubs and spas either out-of-doors or in a building.

In FIG. 1, the cover 10 is shown in its extended position over the top of tub 11. The cover comprises plural ribs 12 which extend across the tub and rest on the upper surface of the tub wall. The ribs are mounted on a flexible sheet 13 and the cover may readily be rolled between the extended position of FIG. 1 and the retracted, rolled position of FIGS. 2 and 3.

The hot tub shown in the drawings is an example of a popular wooden form with vertical wooden staves 15 encircled by steel hoops, one of which is shown at 16. A typical hot tub has a wooden floor, one or more interior seats and a system for circulation of water through a filter and heater, not shown. A tub may be about four feet deep and four to eight feet in diameter. Water temperature is typically maintained at 95°–105° F. The loss of heat from the uncovered water surface is substantial. Moreover, the tub should not be left uncovered when not in use because of the danger of someone falling in.

The ribs and flexible carrier sheet are shown in more detail in FIGS. 4 and 5. A cover for a wooden tub preferably has wooden ribs 12 for uniformity of appearance. The ribs may, of course, be of plastic or metal if desired, and should be of sufficient strength to support a person walking across the cover. The flexible sheet 13 is preferably a foamed plastic material, as polyethylene.

Ribs 12 are secured to flexible sheet 13 with a waterproof adhesive 18. The ribs are of sufficient length to extend across the tub and beyond the outer periphery by an inch or two, as seen in FIG. 5. The flexible sheet 13 is preferably resilient to conform with the top surface of the tub wall staves 15, forming a seal which minimizes air circulation and prevents loss of heat and water vapor. The insulating characteristics of foamed polyethylene also contribute to the heat retention by the cover.

As best seen in FIG. 4, adjacent ribs 12 are spaced apart and the upper longitudinal edges have a complementary configuration so that the cover may be rolled into a compact form, FIGS. 2 and 3. Specific dimensions are related to tub diameter. For example, with a tub six feet in diameter, the ribs may be $3\frac{1}{2}$ inches wide and $1\frac{1}{4}$ inches thick. Spacing between adjacent ribs is 5/16 inch. The upper longitudinal edges are beveled on a 45° angle, leaving a flat upper surface of $1\frac{1}{4}$ inches in width and a vertical edge of $\frac{1}{8}$ inch. The flexible carrier sheet 13 is polyethylene foam $\frac{1}{4}$ inch in thickness.

FIGS. 1, 2 and 3 illustrate a supporting rack 20 to which the cover 10 is secured along a line parallel with the longitudinal extent of the ribs 12. One end of the supporting rack has a roll support 21 mounted on an L-shaped bracket 22 with a diagonal brace 23. Bracket 22 is secured to the outer surface of a stave 15 and is also held by hoop 16. A similar structure (not shown in detail) is provided at the opposite end of supporting rack 20.

Roll support 21 has a concave depression 25 in its upper surface which conforms generally with the shape of the retracted rolled cover. The depression is below the level of the top surface of the tub wall, holding the rolled cover in a stable position at the side of the tub. The rolled cover will not be dislodged from the supporting rack without the application of a force causing it to roll upwardly onto the top surface of the tub wall.

The two roll support members, 21, **21*a*, are spaced apart along a line generally parallel with the ribs 12. Three ribs 12*a*, 12*b* and 12*c* are located outside the tub wall on the supporting rack 20. Rib 12*a* is secured to roll support members 21 and 21*a***, fixing the cover to the tub.

The two roll support rack members 21, **21*a* are mounted to extend radially outward from the tub wall and are angularly spaced 45° apart. Similarly mounted plates may be provided to carry a seat module 26. With the cover anchor and 45° seat modules, a deck may be formed around the entire periphery of the tub, if desired. The center lines of the 45° seat modules are indicated by dashed lines in FIG. 1**. Similar modules may be mounted at a lower level on the tub wall to provide steps.

Cover 10 is preferably provided with a hasp 27 secured to rib **12*d* diametrically opposite the supporting rack 20. The hasp interfits with a lock mechanism 28** to fasten the cover in its extended position.

I claim:

1. A cover for a tub which is defined by a peripheral wall having a top surface, comprising:

a sheet of flexible resilient material;

a plurality of parallel generally straight ribs secured to said sheet, said ribs being spaced apart on said sheet a distance less than the thickness of the ribs;

means fixing the sheet and ribs with respect to the rub wall along a line parallel with said ribs to roll between a rolled retracted position adjacent the tub wall and an extended position covering the tub and resting on the top surface of said peripheral tub wall with said sheet of flexible material interposed between the ribs and said top surface, forming a seal with the top surface, and with said ribs extending from one side of the tub to the other, adjacent ribs having a complementary cross sectional contour whereby said cover may be rolled into a compact form; and a rack adjacent the tub for holding the retracted rolled cover, said rack having a depression in which the rolled cover rests.

2. The tub cover of claim 1 in which said resilient flexible sheet is of a foamed plastic material.

3. The tub cover of claim 1 in which said ribs are generally rectangular in cross-section with upper longitudinal edges thereof having a beveled configuration.

4. The tub cover of claim 1 for a circular cylindrical tub, the lengths of the ribs being slightly greater than the outside wall dimension of the tub chord where each rib rests on the top surface of the tub wall so that the ends of each rib extend outside the tub wall.

5. The tub cover of claim 1 in which the shape of the depression of the rack conforms with the shape of the retracted rolled cover.

6. The tub cover of claim 5 in which the bottom of said depression is below the level of the top of said tub.

7. The tub cover of claim 1 in which a rib is secured to said rack to anchor the cover.

8. The cover of claim 7 in which a plurality of ribs are positioned across said rack outside the periphery of the tub wall.

9. The tub cover of claim 1 having a pair of racks spaced apart along a line generally parallel with the ribs.

* * * * *